US006539726B2

(12) United States Patent
Giesy et al.

(10) Patent No.: US 6,539,726 B2
(45) Date of Patent: Apr. 1, 2003

(54) VAPOR PLUG FOR CRYOGENIC STORAGE VESSELS

(76) Inventors: R. Kevin Giesy, 40068 Montage La., Murrieta, CA (US) 92563; Mark Ventura, 15721 Willett La., Huntington Beach, CA (US) 92647; Funn Roberts, 2458 E. Hunter St., #5, Los Angeles, CA (US) 90021

( * ) Notice: Subject to any disclaimer, the term of this patent is extended or adjusted under 35 U.S.C. 154(b) by 0 days.

(21) Appl. No.: 09/851,407

(22) Filed: May 8, 2001

(65) Prior Publication Data

US 2002/0166326 A1 Nov. 14, 2002

(51) Int. Cl.[7] ..... F17C 7/04

(52) U.S. Cl. ..... 62/48.1; 206/0.7; 220/560.1; 220/592.2; 220/373

(58) Field of Search ..... 62/48.1, 51.1; 206/0.6, 0.7; 220/560.1, 592.2, 367.1, 373

(56) References Cited

U.S. PATENT DOCUMENTS

| | | | | |
|---|---|---|---|---|
| 2,001,989 | A | | 5/1935 | Theuerkauf |
| 2,215,989 | A | | 9/1940 | Wolf |
| 2,396,459 | A | | 3/1946 | Dana |
| 2,986,891 | A | | 6/1961 | McMahon |
| 3,007,596 | A | | 11/1961 | Matsch |
| 3,168,326 | A | | 2/1965 | Conrad et al. |
| 3,187,937 | A | | 6/1965 | Berta |
| 3,204,849 | A | | 9/1965 | Vinney |
| 3,238,002 | A | | 3/1966 | O'Connell et al. |
| 3,298,185 | A | | 1/1967 | Loudon |
| 3,375,933 | A | | 4/1968 | Rodman |
| 3,507,444 | A | | 4/1970 | Werby |
| 3,602,003 | A | | 8/1971 | Hampton |
| 3,625,351 | A | | 12/1971 | Eisenberg |
| 3,628,347 | A | * | 12/1971 | Puckett et al. ..... 62/48.1 |
| 3,648,018 | A | * | 3/1972 | Cheng et al. ..... 62/48.1 |
| 3,651,926 | A | | 3/1972 | Elfast, Jr. |
| 3,670,918 | A | | 6/1972 | Mitchell |
| 3,675,844 | A | | 7/1972 | Sorrell |
| 3,698,200 | A | | 10/1972 | Johnson et al. |
| 3,705,498 | A | | 12/1972 | Dehaan |
| 3,717,005 | A | | 2/1973 | McGrew et al. |
| 3,819,106 | A | | 6/1974 | Schuster |
| 3,828,608 | A | | 8/1974 | Yamamoto |
| 3,875,754 | A | | 4/1975 | Faust et al. |
| 3,938,346 | A | | 2/1976 | Ovchinnikov et al. |
| 3,948,409 | A | | 4/1976 | Ovchinnikov et al. |

(List continued on next page.)

FOREIGN PATENT DOCUMENTS

| | | |
|---|---|---|
| CA | 1219821 | 3/1987 |

*Primary Examiner*—Ronald Capossela
(74) *Attorney, Agent, or Firm*—Roy L. Anderson

(57) ABSTRACT

A thermal barrier for a Dewar vessel combines an insulative vapor plug and a vapor barrier. The plug is sized so as to define an open space between it and the neck portion of the Dewar vessel to allow venting of vaporous cryogen from the inner vessel of the Dewar vessel through a Dewar opening. The vapor barrier provides an interference between the plug and the neck portion that disrupts venting of vaporous cryogen but does not form an airtight seal that would block venting and cause unacceptable build-up of pressure within the inner vessel. Multiple vapor barriers, especially four or more, provide multiple interferences that create multiple chambers between the plug and the neck portion. Each interference disrupts migration of vaporous cryogen as an incremental increase (e.g., 2 psig or less) in vapor pressure of each chamber causes the chamber to breach and then another incremental increase in vapor pressure of the liquid cryogen in the vaporous state is required to breach each successive chamber. The thermal barrier can be inserted into the neck portion of a conventional Dewar vessel to increase its holding time.

28 Claims, 7 Drawing Sheets

U.S. PATENT DOCUMENTS 3,984,222 A 10/1976 Dehaan
3,999,653 A 12/1976 Haigh et al.
4,000,815 A 1/1977 Wingbro et al.
4,131,200 A 12/1978 Rainfret
4,168,014 A 9/1979 Schultz et al.
4,240,547 A 12/1980 Taylor
4,259,846 A 4/1981 Rudolphi
4,264,031 A 4/1981 Goebel
4,306,425 A 12/1981 Sitte et al.
4,377,077 A 3/1983 Granlund
4,390,111 A 6/1983 Robbins et al.
4,396,113 A 8/1983 Gail et al.
4,411,138 A 10/1983 Leithauser et al.
4,455,842 A 6/1984 Granlund
4,481,779 A 11/1984 Barthel
4,495,775 A 1/1985 Young et al.
4,510,621 A 4/1985 Sak et al.
4,646,934 A 3/1987 McAllister
4,670,396 A 6/1987 Bear et al.
4,694,655 A 9/1987 Seidel et al.
4,729,494 A 3/1988 Peillon et al.
4,741,346 A 5/1988 Wong et al.
4,790,141 A 12/1988 Glascock
4,821,907 A 4/1989 Castles et al.
4,872,563 A 10/1989 Warder et al.
4,903,493 A 2/1990 VanIperen et al.
4,925,060 A 5/1990 Gustafson
4,932,533 A 6/1990 Collier
4,948,035 A 8/1990 Wischoff
4,974,423 A 12/1990 Pring
4,988,014 A 1/1991 Varchese et al.
5,005,362 A 4/1991 Weltmer, Jr. et al.
5,024,865 A 6/1991 Insley
5,029,699 A 7/1991 Insley et al.
5,040,678 A 8/1991 Lenmark, Sr. et al.
5,160,021 A 11/1992 Sibley et al.
5,199,795 A 4/1993 Russo et al.
5,219,504 A 6/1993 Insley
5,291,997 A 3/1994 He et al.
5,296,834 A 3/1994 Urban
5,321,995 A 6/1994 Leonard
5,355,684 A 10/1994 Guice
5,419,143 A 5/1995 Leonard et al.
5,462,875 A 10/1995 Barr et al.
5,464,116 A 11/1995 Aoki et al.
5,484,100 A 1/1996 Rigby
5,509,255 A 4/1996 Rutledge
5,578,491 A 11/1996 Kayal et al.
5,582,887 A 12/1996 Etheredge
5,620,110 A 4/1997 Delatte et al.
5,640,853 A * 6/1997 Baker et al. ..... 62/48.1
5,651,473 A 7/1997 Preston et al.
5,711,446 A 1/1998 Jeffs et al.
5,779,089 A 7/1998 West
5,829,594 A 11/1998 Warder
5,833,057 A 11/1998 Char et al.
5,856,172 A 1/1999 Greenwood et al.
5,894,733 A 4/1999 Brodner
5,906,101 A 5/1999 Rajotte et al.
5,921,396 A 7/1999 Brown, Jr.
5,928,935 A 7/1999 Reuss, Jr. et al.
5,934,099 A 8/1999 Cook et al..
5,935,848 A 8/1999 Sputtek et al.
5,947,960 A 9/1999 Griswold
6,036,045 A 3/2000 West
6,119,465 A 9/2000 Mullens et al.
6,145,688 A 11/2000 Smith
6,146,875 A 11/2000 Ward

* cited by examiner

VAPOR PLUG FOR CRYOGENIC STORAGE VESSELS

FIELD OF THE INVENTION

The present invention is in the field of cryogenic shipping containers.

BACKGROUND OF THE INVENTION

Commercial cryogenic equipment manufacturing goes back more than five decades. Union Carbide Corp. was a pioneer in developing many of the design and manufacturing methods, many of which are still in use today. U.S. Pat. No. 4,154,363, filed in 1975 for "Cryogenic Storage Container and Manufacture," captures the essence of defining how such a vessel is made, and therefore its disclosure is specifically incorporated herein by reference. These kinds of containers were intended for the storage of liquefied gases like liquid nitrogen (LN2). They were constructed in sizes and materials meant to provide portability for the transport of liquid nitrogen or biological materials frozen in LN2.

A further improvement in storage containers, especially for safer transport of LN2 stored in the absorbed vapor phase, can be found in U.S. Pat. No. 4,481,779, filed in 1983 for "Cryogenic Storage Container." This patent introduced the design for a so-called "dry shipper" intended to transport frozen biological specimens with less risk of liquid nitrogen release.

Refinements continued with the issuance in 1994 of U.S. Pat. No. 5,321,955 for "Cryogenic Shipping System," comprised among other things of a dewar having a top opening with one or more specimen holders suspended within the dewar. Specifically, a specimen holder design with a mostly cylindrical, open-mouthed metal canister attached to a rod made partially of a non-metallic, low heat transfer material known as composite.

As recently as 1995, U.S. Pat. No. 5,419,143 issued for "Cryogenic Apparatus for Sample Protection in a Dewar." Principally, this patent provided a convenient and inexpensive conversion of cryogenic storage dewars for shipping, an improved ability to maintain samples in a cold state for longer periods of time and an improved sample holder with protection against a loss of liquid cryogen.

In all cases, as far back as these kinds of cryogenic storage and shipping containers go, the general concept for plugging the opening to the inner vessel was a loose-fitting, round vapor plug. This plug was made of closed-cell foam for insulation of the heat conduction pathway through the neck tube opening. The reason for making the foam plug slightly smaller than the neck tube, typically 0.1 inch or less in diameter, was to provide an escape path for boiling vapors and assure that no pressure build-up would occur inside the container holding cryogenic liquefied gas.

In each case the vapor plug and its plastic handle were purposefully kept from positively engaging the neck tube interior surface for fear of trapping boiling vapors leading to a pressure rise inside of the container. Thus, the plug and its handle would not create any tight fitting interference between itself and the neck tube.

In 2000, with the issuance of U.S. Pat. No. 6,119,465 for a Shipping Container for Storing Materials at Cryogenic Temperature, comprised among other things of a Dewar having a top opening with a removable and replaceable cap for enclosing the specimen holding chamber creating a vented seal, a first attempt was made at controlling the migration of boiling vapors within the container. While clever in its ability to provide a more secure means of holding the specimens within the interior chamber, the cap does little to aid in the thermal performance of the overall container design. A loose fitting foam spacer sits atop the specimen chamber beneath the cap to act as an insulator.

As use of cryogenic shipping containers grows, specifically the use of fully absorbed LN2 dry vapor shippers, the challenges of good thermal management through carefully controlled heat transfer become increasingly significant. Since almost all LN2 containers utilize double-walled vacuum vessels with high performance (super) insulation to minimize heat transfer through the vessel sidewalls, the top opening becomes a principle means of heat transfer. Perhaps half the heat leak comes from the top opening of the container, depending on its size in comparison to the overall vessel size.

Use of poor heat conducting materials such as closed-cell foam insulation for the plug has been the historical means of minimizing heat leak through the neck opening. It is fairly effective at reducing heat transfer by convection in the bulk open space by displacing the majority of the gaseous vapors. However, the perimeter space created by the purposeful gap between the vapor plug and the inside surface of the neck tube does allow a "channel" of vapor migration to remain. This channel is designed to allow the boiling liquid vapors a path to escape the container without building hazardous internal pressure.

When cryogenic storage containers remain in their preferred upright (top end up) position, the typical vapor plug arrangement described previously works well. However, in transit during shipment it is often impossible to assure that the container will remain upright. Despite the creativity of some packaging design, it is almost inevitable that some number of cryogenic shipping containers will transit on their sides, or worse yet, upside down.

Accordingly, there is a long-felt need for an improved vapor plug for use in cryogenic shipping and storing containers that provides increased thermal performance, and especially for increased thermal performance when the cryogenic container is not in its preferred upright position.

By using unique, lightweight, low-cost, semi-disposable, cryogenically compatible polymer films in combination with the foam insulation materials for the plug, the vapor phase LN2 dry shipper according to the present invention overcomes the above-mentioned disadvantages of the prior art. This is accomplished in an inherently elegant, reliable, and inexpensive adaptation of the foam vapor plug, which will result in improved retention of absorbed LN2 vapors, enhance the shipper's tolerance of non-upright orientation during transit, and increase reliability and safety, with fewer in-service incidents of loss of cryogen.

SUMMARY OF THE INVENTION

The present invention is generally directed to an improved thermal barrier for a Dewar vessel and a Dewar vessel containing the thermal barrier. The thermal barrier is an insulative vapor plug and a vapor barrier. The plug is sized so as to define an open space between it and the neck portion of the Dewar vessel to allow venting of vaporous cryogen from the inner vessel of the Dewar vessel through a Dewar opening. The vapor barrier provides an interference between the plug and the neck portion that disrupts venting of vaporous cryogen but does not form an airtight seal that would block venting.

In a first, separate group of aspects of the present invention, the vapor barrier is made up of multiple vapor barriers, preferably four or more, that provide multiple interferences that can create chambers between the plug and the neck portion. Each interference disrupts migration of vaporous cryogen as an incremental increase (e.g., 2 psig or less) in vapor pressure of each chamber causes the chamber to breach and then another incremental increase in vapor pressure of the liquid cryogen in the vaporous state is required to breach each successive chamber.

In other, separate aspects of the present invention, a vapor barrier is made of a cryogenically compatible material, such as a polymer film, that retains vaporous cryogen within the vessel despite its orientation. A surface protrusion can be provided for the plug to inhibit the mean free path of dense, boiling vapors through the Dewar opening. Multiple protrusions can be affixed to the plug (which can occupy a majority of the open space within the neck portion) by lamination so that they extend outwardly from an outer surface of the plug. A handle, which can be made of webbing material, can extend through the plug and be attached to the plug at a bottom point located beneath any laminations so that the plug can be removed from the vessel by an upward pulling force exerted on the bottom point. The handle can also be affixed to a canister assembly.

In still other, separate aspects of the present invention, an insulative vapor plug and a vapor barrier can be inserted into the neck portion of a conventional Dewar vessel to increase its holding time.

Accordingly, it is a primary object of the present invention to provide an improved thermal barrier for a Dewar vessel that can increase its holding time.

This and further objects and advantages will be apparent to those skilled in the art in connection with the drawings and the detailed description of the preferred embodiment set forth below.

BRIEF DESCRIPTION OF THE DRAWINGS

The drawings constitute a part of this description and include exemplary embodiments of the present invention, which may be embodied in various forms other than that shown herein. It is to be understood that in some instances various aspects of the invention may be shown exaggerated or enlarged to facilitate a better understanding of the invention.

DETAILED DESCRIPTION OF THE PREFERRED EMBODIMENTS

In accordance with the preferred embodiment of the present invention, a Dewar vessel used as a cryogenic storage and shipping container is provided with an improved thermal barrier for its Dewar opening. The thermal barrier is a vapor plug having vapor barrier protrusions or rings that occupy the annular space between the foam plug material and the neck tube that joins the inner and outer vessels of the Dewar vessel. These changes increase the thermal performance of the cryogenic container by providing better control of convective heat transfer resulting from migration of dense, boiling vapors past the vapor plug. The result is a cryogenic shipping container that is not as prone to premature loss of cryogen which keeps its contents at or below 100K. for a longer period of time, based on its rated performance, even when it is not in its preferred upright position. This means that the shipping container is less sensitive to its shipping orientation and therefore it is safer to ship.

A thermal barrier in accordance with the preferred embodiment provides a surface protrusion for an insulation foam plug to inhibit the mean free path of dense, boiling vapors between itself and the neck tube that joins the inner and outer vessels of current cryogenic storage and shipping containers. The protrusions or rings used in the plug can be made of an inexpensive, cryogenically compatible polymer film or other suitable means for retaining dense, boiling vapors within the container despite its orientation. Accordingly, such a plug can be used to provide an inexpensive mechanism for retrofit adaptation or replacement of vapor plugs in current cryogenic storage and shipping containers.

Figure 1:
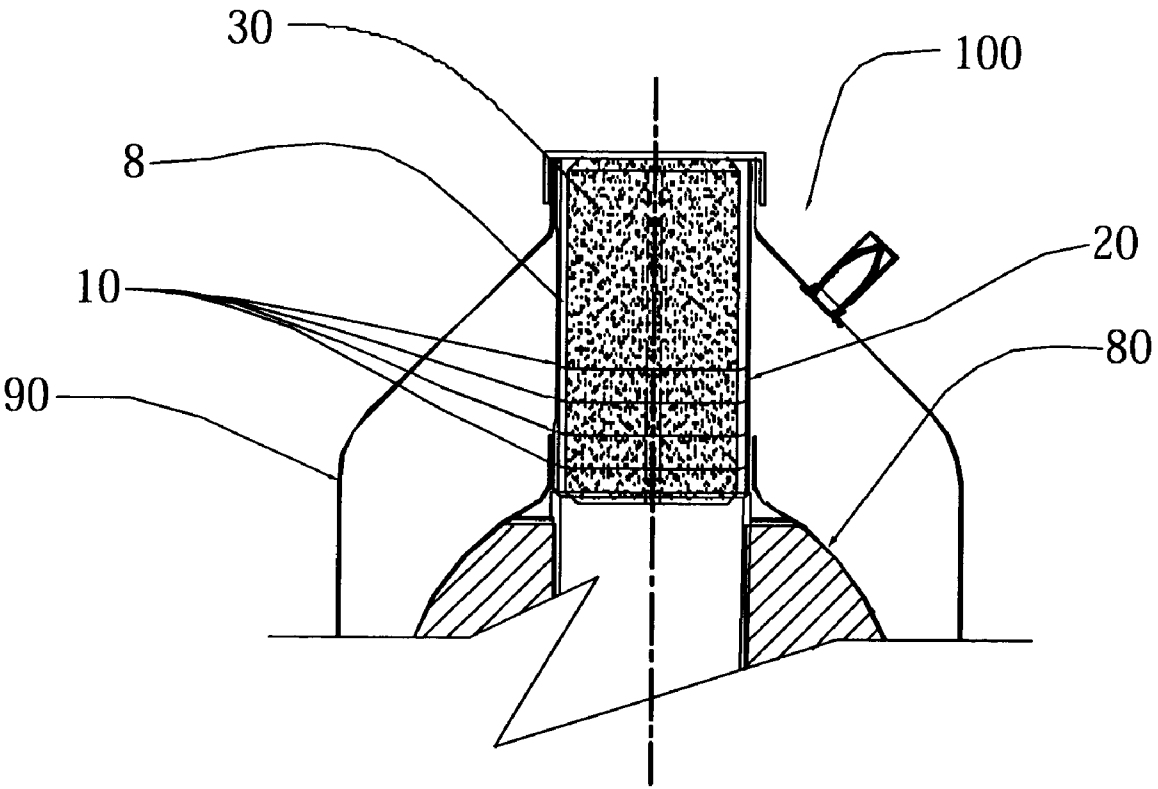
FIG. 1 is a side section view of a cryogenic shipping container in the region of a vapor plug according to the present invention indicating the vapor escape path.

Referring now to FIG. 1, cryogenic shipping container 100 is shown in side section view. A typical foam insulation vapor plug material 30 is inserted into open space 8. Open space 8 is defined as the interior confines of neck tube 20 that connects inner vessel 80 and outer vessel 90 of cryogenic shipping container 100. A plurality of vapor barrier protrusions 10 are shown extending from the sides of vapor plug material 30 creating interferences within open space 8 between plug 30 and neck tube 20, and it is especially preferred that there be four or more vapor barrier protrusions 10.

Figure 2:
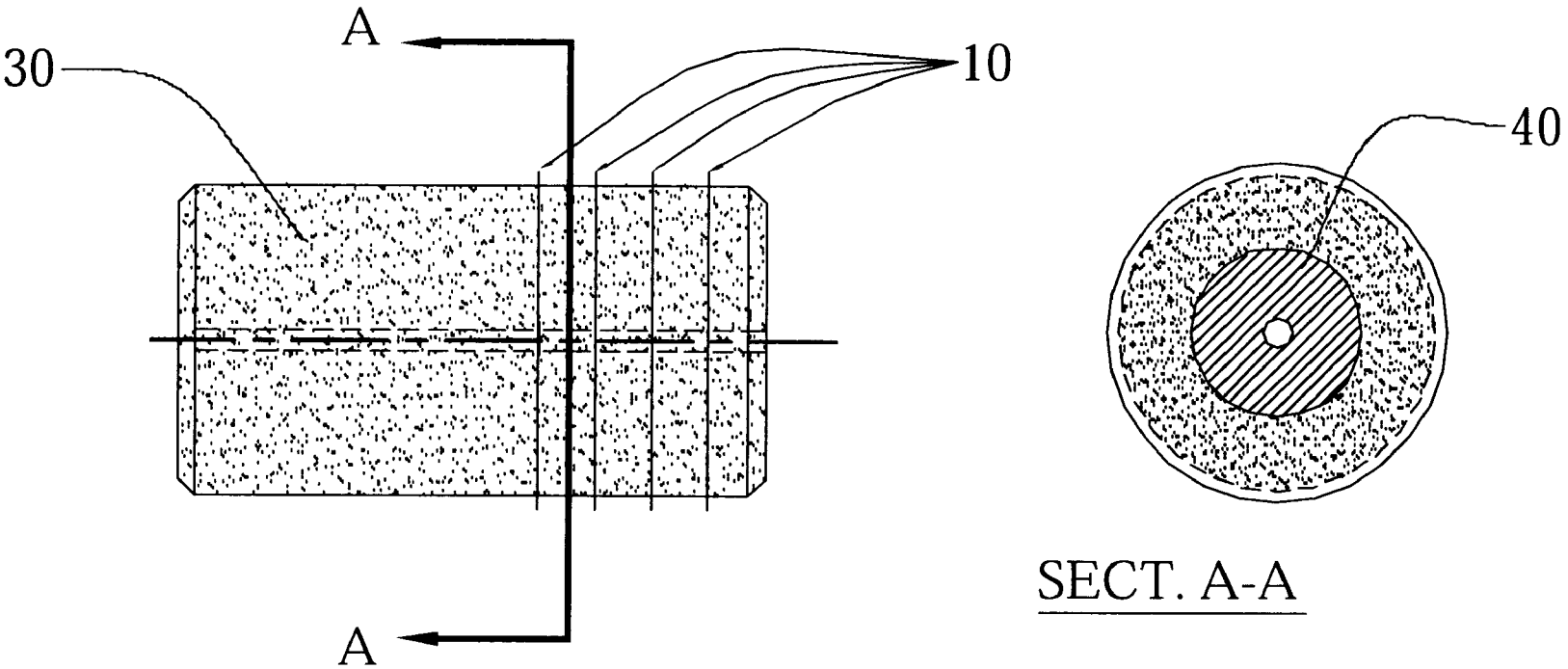
FIG. 2 is an assembly view of an improved vapor plug according to the present invention showing a plurality of vapor barrier protrusions.

Referring now to FIG. 2, one sees that foam plug material 30 has extensions around its perimeter formed by vapor barrier protrusions 10. A plurality of barrier protrusions is shown in this preferred embodiment. Barrier protrusions 10 are made of cryogenically compatible polymer films such as Kapton® polyimide or Teflon® FEP from DuPont. Tyvek® spunbonded olefin that is made from very fine continuous filaments of high-density polyethylene (HDPE) bonded together by heat and pressure also works well.

The construction of foam plug material 30 and vapor barrier films 10 can be done using glue or adhesive 40 to laminate vapor barrier protrusions 40 into foam material 30.

Figure 3:
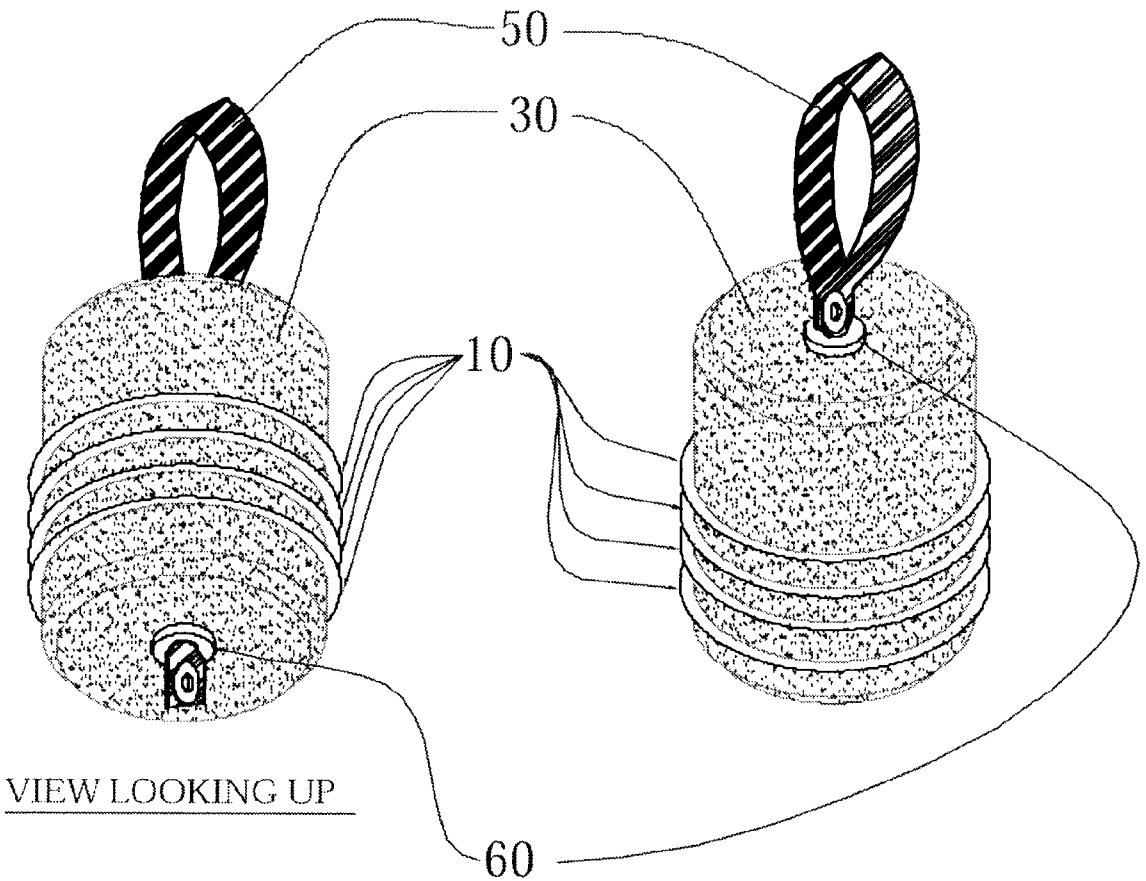
FIG. 3 is a schematic orthographic view of an improved vapor plug according to the present invention with attached handle.

Referring now to FIG. 3, foam plug material 30 and vapor barrier films 10 can be assembled with a simple handle 50 made of webbing fabric. The webbing handle provides a means of inserting and removing the vapor plug assembly without having to pull directly on foam plug material 30, thus avoiding the risk of breakage of glue 40. Using washer and grommet 60 attached to handle 50 just above and beneath the foam plug material 30 secures the entire assembly together.

Figure 4:
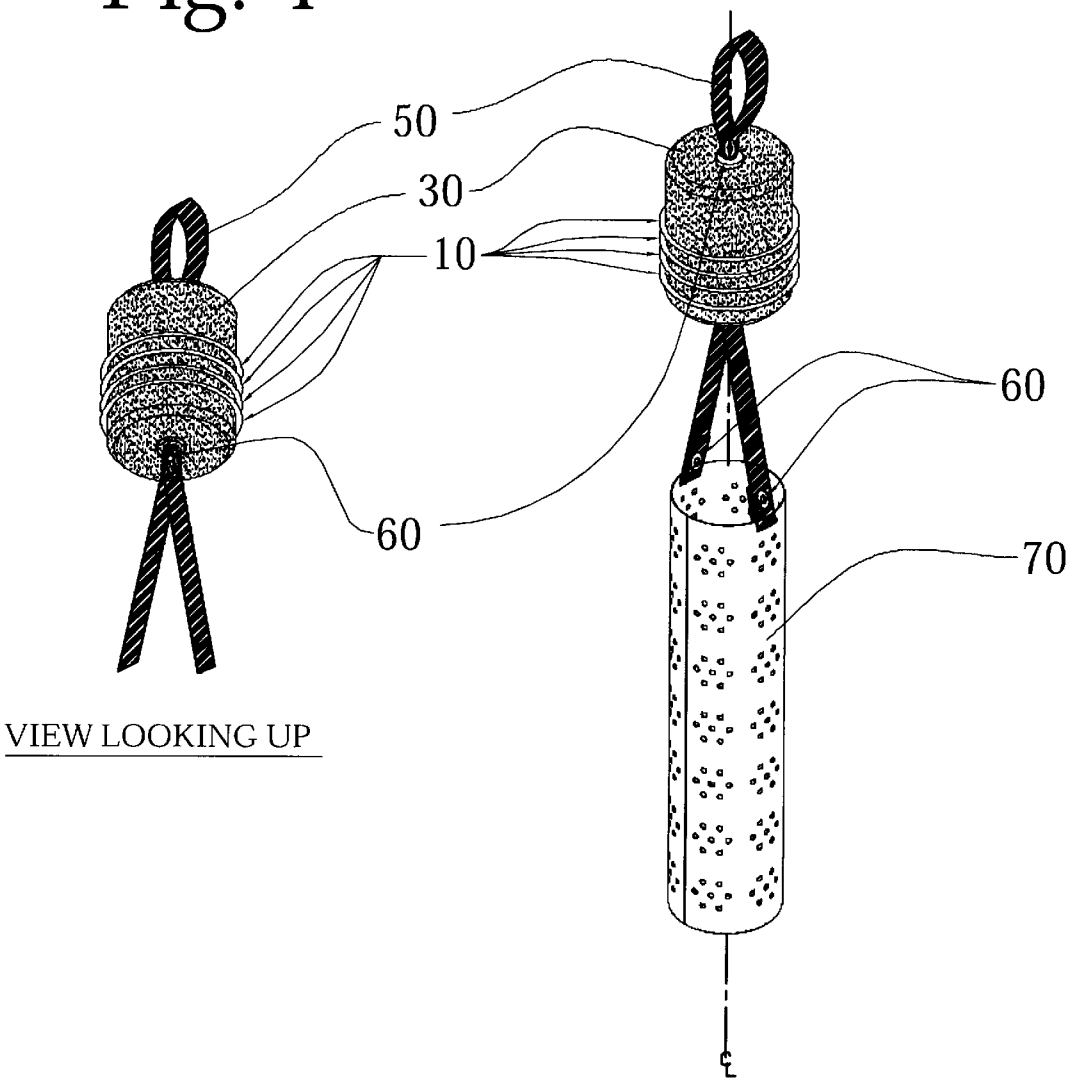
FIG. 4 is a schematic orthographic view of an improved vapor plug according to the present invention with attached handle and canister assembly.

Referring now to FIG. 4, foam plug material 30 and vapor barrier films 10 can also be assembled with handle 50 made of webbing fabric attached to canister 70 meant to hold biological materials being shipped at cryogenic temperatures. Again, the webbing handle provides a means of inserting and removing the vapor plug and canister assembly without having to pull directly on foam plug material 30 so as to avoid risk of breakage of glue 40. Using a washer and grommet 60 attached to handle 50 just above and beneath the foam plug material 30 secures the entire assembly together.

As a first line of insulation, insulation foam material 30 is contained within a double-walled vacuum vessel (Dewar) as shown in FIG. 1. The Dewar is constructed of inner vessel 80 connected to outer vessel 90 by use of neck tube 20. Neck tube 20 is typically made of a composite material like fiberglass. Inner vessel 80 contains the cryogenic fluid (typically LN2 either in the liquid form or fully absorbed into a LN2 saturated absorbent). Even the best thermal management designs for cryogenic storage systems must deal with the inevitable influx of heat into inner vessel 80 and the resulting boiling of the liquefied gas. The typical Dewar construction relies upon a high vacuum space between inner and outer vessels 80 and 90, which is typically filled with multi-layered insulation (not shown), to provide the greatest level of thermal protection for inner vessel 80. This leaves opening 8 as the next greatest path of heat leakage, and this path is typically minimized by foam plug material 30. Foam plug material 30 is typically made of closed-cell insulation materials that provide low heat conductance properties and minimize heat transfer through opening 8.

Prior art foam plug materials 30 are purposefully made smaller than the inside dimensions of neck tube 20 to prevent a strong seal from forming between foam plug material 30 and neck tube 20. Such a seal is avoided because it would lead to a dangerous pressure build-up inside of container 80 when stored cryogenic liquid inside of inner vessel 80 begins boiling as a result of inevitable heat leakage into inner vessel 80. When cryogenic container 100 is maintained in its desired upright position, the vapor path remains above inner vessel 80 and the pool of super cold, dense vapor constantly boiling away from the cryogenic liquid stays essentially beneath foam plug material 30. The very slight pressure rise within inner vessel 80 expels the vapors through open space 8 and safely out of container 100.

Since the market for shipping of frozen biological materials has grown with the emerging biotech industry, the use of cryogenic shipping containers will also grow. More cryogenic shippers being handled and transported by freight forwarders like FedEx® UPS®) and others means these shippers will be treated more like common containers or boxes. This will unavoidably result in cryogenic shippers being transported in orientations other than the preferred upright position. When these kinds of cryogenic storage containers are placed on their side, or worse yet, upside down, it is well known that their thermal performance will degrade. The basic reason for the change in thermal performance has to do with the fact that the cold, dense vapors that constantly boil away from the cryogenic liquid act like a fluid themselves. Said another way, the cold, dense vapors constantly "pour" out of the cryogenic container migrating past the common foam plug 30 in open space 8 creating a greater heat leak through the frozen sidewall of plug 30 and neck tube 20.

Figure 5:
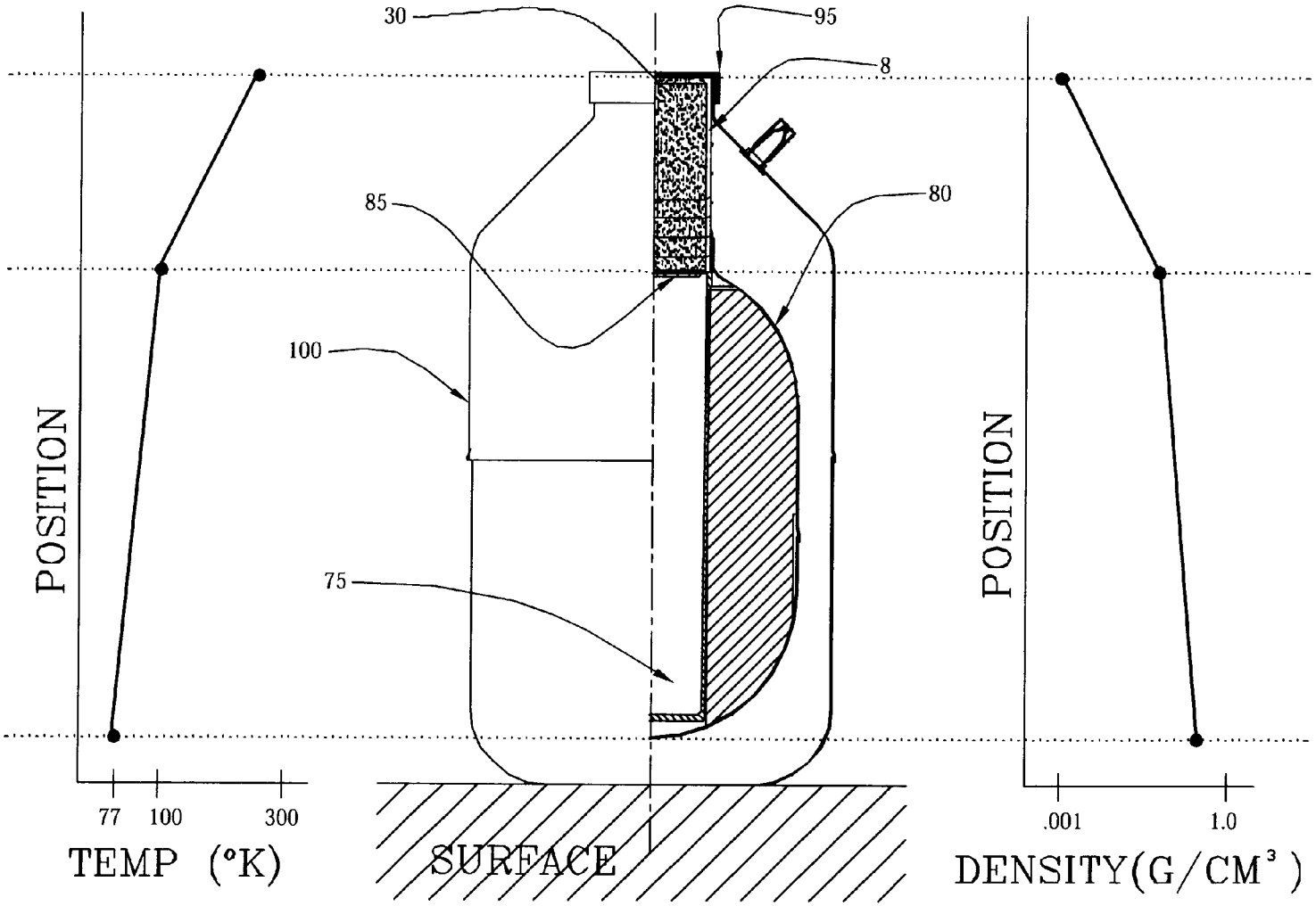
FIG. 5 is a schematic view of a cryogenic shipping container with an improved vapor plug according to the present invention sitting in its preferred vertical orientation with data charts for temperature and density distribution.

Referring now to FIG. 5, one sees that cryogenic shipping container 100 positioned in the preferred upright (vertical) orientation takes maximum advantage of its thermal insulation design. Meaning that the cold, dense vapors remain essentially "trapped" at bottom end 75 of the specimen chamber inside of inner container 80. The charts shown along with FIG. 5 indicate that the temperature of inner vessel 80 beneath neck tube 85 remains below 100° K. with the density at or above 0.7 g/cc. However, abrupt changes in vapor temperature and density occur along the length of neck tube 85 and vapor plug 30—the vapors approach ambient temperature as they exit the non-sealed cap 95 and the density of vapor falls several orders of magnitude, approaching that of ambient air.

Figure 6:
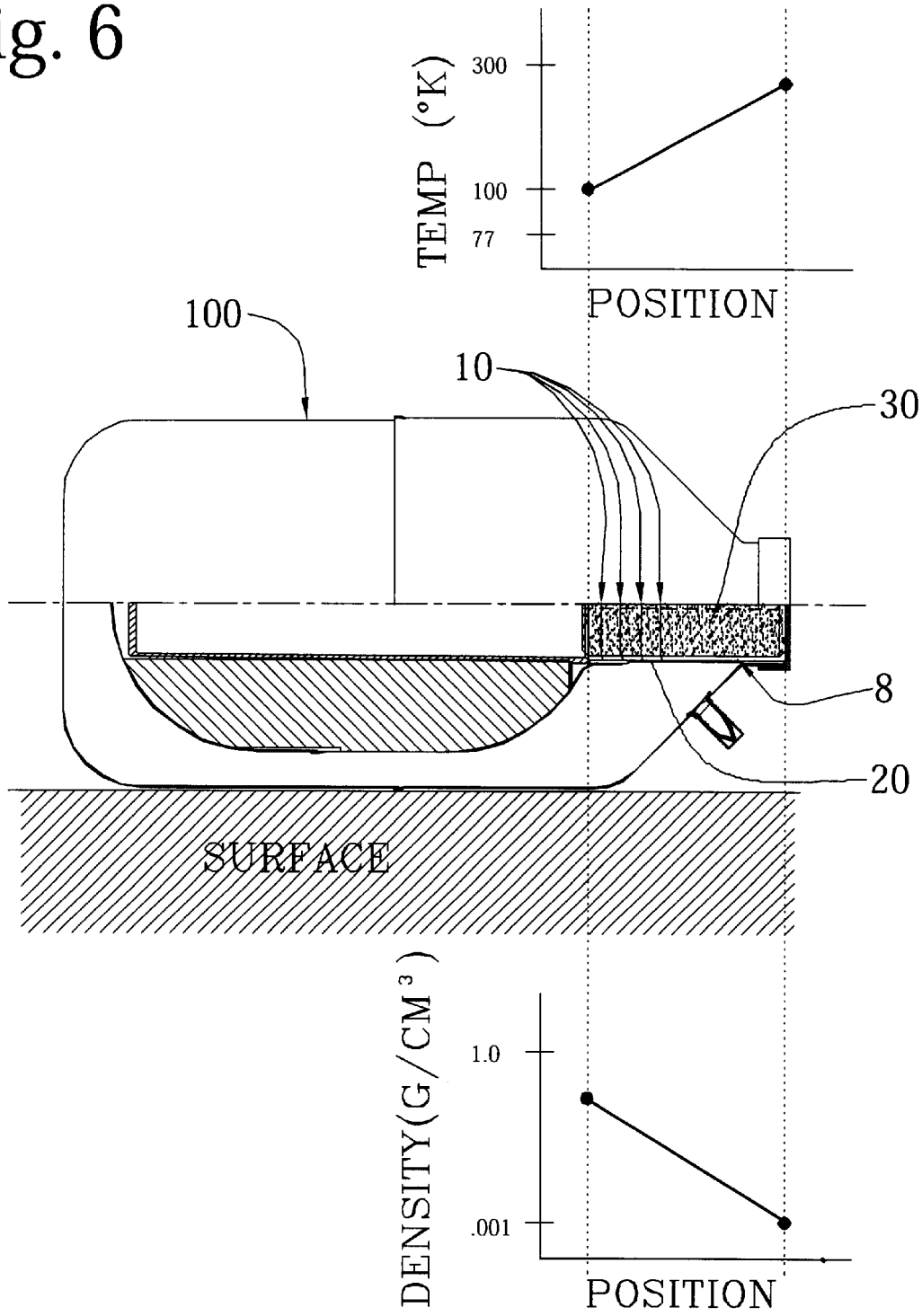
FIG. 6 is a schematic view of the cryogenic shipping container shown in FIG. 5 sitting in the less desirable horizontal orientation with data charts for temperature and density distribution.
Figure 7:
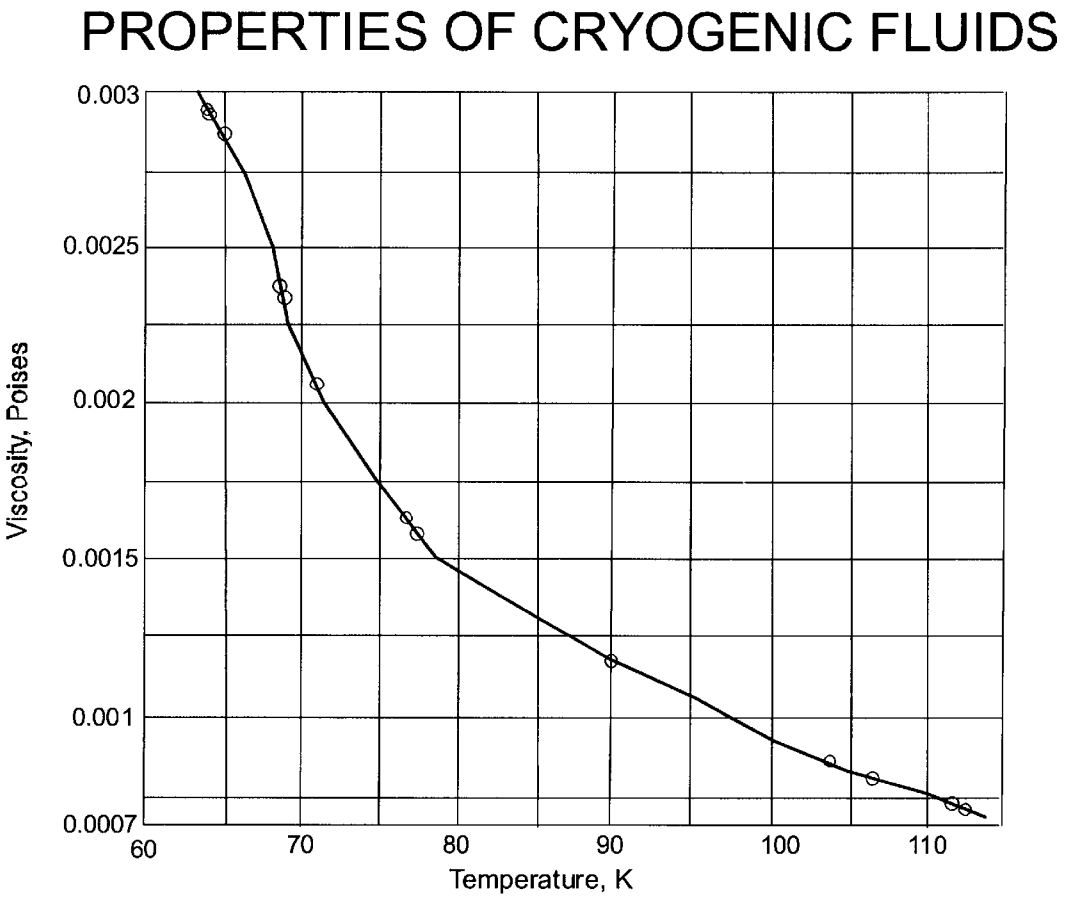
FIG. 7 is a chart of viscosity of liquid nitrogen as a function of temperature change taken from *Cryogenic Engineering,* Scott, Russell B., (1963) reprinted by Met-Chem Research Inc., 1988, page 281, the disclosure of which is specifically incorporated herein by reference.

Referring now to FIG. 6, one sees that cryogenic shipping container 100 positioned in the less desirable sideways (horizontal) orientation suffers from the migration of cold, dense vapors right up to and past neck tube 20 and vapor plug 30 through open space 8. Without aid of protrusions 10 or other means of inhibiting fluid flow according to the present invention, the excellent thermal insulation system for cryogenic storage is rendered less than adequate. Referring to FIG. 7, one sees that the viscosity of liquid nitrogen is greatly influenced by its temperature. At temperatures below 100° K., as found inside of inner vessel 80, the cold nitrogen vapors act much like a fluid such as water, although less dense. When a cryogenic shipping container is then placed in a horizontal position, or worse yet, upside down, the viscous cold vapors simply pour out, much like water.

An effective method of reducing heat transfer to the storage vessel is incorporated into the improved neck plug of the present invention. This entails using the protrusions 10 emanating from foam plug 30 to provide greater interference within open space 8 with neck tube 20 to create a barrier, or series of barriers, thus inhibiting the streaming of cold, dense vapors directly past the plug. Protrusions 10 are specifically not meant to form an air tight seal between foam plug material 30 and neck tube 20, but rather are designed to create an interference barrier to disrupt the migration of cold, dense vapors emitted by the constantly boiling cryogenic liquid. In the context of this invention, an air tight seal means a seal that allows an impermissible build-up of pressure within the inner vessel of the shipping container. (According to current DOT regulation, any build-up of 25 psig or greater is impermissible, so any seal that would allow this great of a build-up would be considered an air tight seal in the context of the present invention at the present time.) A plurality of barriers creates the ideal embodiment by providing redundancy and a greater torturous pathway for vapor to overcome. Once again, the kinds of polymer films that the vapor barriers are made from are inherently thin and unable to produce a structural membrane to support any seal loads or appreciable pressure build-up within the container. However, these same materials are able to remain intact and resilient enough at cryogenic temperatures to withstand repeated movement and deformation as the vapor plug assembly is inserted and removed from the cryogenic shipper. These same barrier materials act like dams and keep the cold, dense vapors from easily pouring through the opening 8 between the vapor plug 30 and neck tube 20. The result is a cascade-like flow in which a chamber defined by two barriers must first be breached by an increase in pressure, followed by expansion into the next chamber, followed by another increase in pressure leading to another breach, and so on.

Evidence of the beneficial features of the present invention were demonstrated by measuring the normal evaporation rate (NER) of some commercially available cryogenic shippers equipped with their standard vapor plug and the same containers equipped with improved vapor plugs of the present invention. The original performance figure for the reference samples was a specified NER of 0.5 kg per day of the LN2 charge. Tests performed on the reference samples in accordance with the published procedures gave an average NER of 0.510 kg/day for a sample lot of eight articles. As stated, these test articles were measured with the cryogenic container kept in the preferred upright position throughout the 72 hours long test. These same test articles were again tested for NER but with each one turned on its side with a very slight 6° positive slope from horizontal for the open end. The test articles remained in the near horizontal position throughout the entire 72 hours long test. The average NER was 1.25 kg/day loss or much more than twice as high as the rated and demonstrated NER in the preferred upright position. Afterwards, these same test articles had their vapor plugs modified with a plurality of vapor barriers in accordance with the present invention and the same near horizontal NER testing was repeated. The average NER improved to 0.625 kg/day loss or less than a 25% rise in thermal performance.

In practical terms, this demonstrated level of retention of thermal performance translates accordingly for holding time, the fundamental requirement for a cryogenic shipping container. The particular reference articles tested above are capable of holding a full charge of 5.0 liters of LN2, or just over 4.0 kilograms weight of cryogenic liquid. Based on the rated and demonstrated NER in the preferred upright position, these particular containers offer 8 days of holding time. When the same containers are tested (or used in real life) in the horizontal position without modifications to the vapor plug, the demonstrated holding time is reduced to just over 3 days; hardly enough time to last the typical trans-oceanic shipment process. However, when these same test articles were equipped with the improved vapor plug the retained thermal performance translates into a practical holding time of more than 6 days; doubling the capability of the very same containers when placed in the horizontal position. Thus, the subject invention has been shown to offer very real and practical advantages for the cryogenic shipping container that is likely to encounter prolonged periods of transit time in positions other than just upright.

Although the foregoing detailed descriptions are illustrative of preferred embodiments of the present invention, it is to be understood that additional embodiments thereof will be obvious to those skilled in the art. Further modifications are also possible in alternative embodiments without departing from the inventive concept. Therefore, specific details disclosed herein are not to be interpreted as limiting, but merely as a basis for the claims and as a representative basis for teaching one skilled in the art how to employ the present invention in an appropriately detailed embodiment. For instance, while the present invention is shown embodied with the enhancement features applied to the vapor plug, the same basic enhancements can be obtained by like modification of the neck tube.

Accordingly, it will be apparent to those skilled in the art that still further changes and modifications in the actual concepts described herein can readily be made without departing from the spirit and scope of the disclosed inventions as defined by the following claims.

What is claimed is:

1. A Dewar vessel having an outer casing and an inner vessel with each having openings at their tops connected together by a neck portion forming an evacuable space between the outer casing and the inner vessel and a Dewar opening into the inner vessel, the improvement comprising:

an insulative vapor plug held within the neck portion; and a vapor barrier that provides an interference between the plug and the neck portion;

wherein the plug and the neck portion are sized so as to define an open space between them that allows a liquid cryogen in a vaporous state to vent from the inner vessel through the Dewar opening; and wherein the interference disrupts migration of the liquid cryogen in the vaporous state out of the Dewar opening through the open space but does not form an air tight seal between the plug and the neck portion.

2. A Dewar vessel as recited in claim 1, wherein the vapor barrier is comprised of a plurality of vapor barriers that provide a plurality of interferences between the plug and the neck portion and each of the plurality of interferences disrupts migration of the liquid cryogen in the vaporous state out of the Dewar opening through the open space and the plurality of interferences does not form the air tight seal.

3. A Dewar vessel as recited in claim 2, wherein the plurality of interferences define a plurality of chambers each of which disrupts migration of the liquid cryogen in the vaporous state out of the Dewar opening through the open space.

4. A Dewar vessel as recited in claim 3, wherein the plurality of chambers are sequentially breached as an incremental increase in vapor pressure of the liquid cryogen in the vaporous state in each given chamber causes the given chamber to breach and then another incremental increase in vapor pressure of the liquid cryogen in the vaporous state is required to breach another given chamber.

5. A Dewar vessel as recited in claim 1, wherein the vapor barrier is comprised of a cryogenically compatible material.

6. A Dewar vessel as recited in claim 5, wherein the cryogenically compatible material is a polymer film.

7. A Dewar vessel as recited in claim 5, further comprising:

a handle attached to the plug.

8. A Dewar vessel as recited in claim 7, wherein the handle extends through the plug and is affixed to a canister assembly.

9. A Dewar vessel as recited in claim 1, wherein the vapor barrier retains the liquid cryogen in the vaporous state within the vessel despite its orientation.

10. A Dewar vessel as recited in claim 1, wherein the vapor barrier provides a surface protrusion for the plug to inhibit the mean free path of dense, boiling vapors through the Dewar opening.

11. A Dewar vessel as recited in claim 10, wherein the plug occupies a majority of the open space within the neck portion.

12. A thermal barrier for a Dewar vessel having an outer casing and an inner vessel with each having openings at their tops connected together by a neck portion forming an evacuable space between the outer casing and the inner vessel and a Dewar opening into the inner vessel, comprising:

an insulative vapor plug sized so as to define an open space between it and the neck portion that allows a liquid cryogen in a vaporous state to vent from the inner vessel through the Dewar opening; and a vapor barrier that provides an interference between the plug and the neck portion to disrupt migration of a liquid cryogen in a vaporous state out of the Dewar opening through the open space;

wherein the vapor barrier does not form an airtight seal between the plug and the neck portion.

13. A thermal barrier as recited in claim 12, wherein the vapor barrier is comprised of a plurality of vapor barriers that provide a plurality of interferences between the plug and the neck portion and each of the plurality of interferences disrupts migration of the liquid cryogen in the vaporous state out of the Dewar opening through the open space and the plurality of interferences does not form the air tight seal.

14. A thermal barrier as recited in claim 13, wherein the plurality of interferences define a plurality of chambers each of which disrupts migration of the liquid cryogen in the vaporous state out of the Dewar opening through the open space.

15. A thermal barrier as recited in claim 14, wherein the plurality of chambers are sequentially breached as an incremental increase in vapor pressure of the liquid cryogen in the vaporous state in each given chamber causes the given chamber to breach and then another incremental increase in vapor pressure of the liquid cryogen in the vaporous state is required to breach another given chamber.

16. A thermal barrier as recited in claim 15, wherein the plurality of vapor barriers is comprised of four or more vapor barriers.

17. A thermal barrier as recited in claim 15, wherein the plurality of vapor barriers is comprised of a cryogenically compatible material.

18. A thermal barrier as recited in claim 17, wherein the cryogenically compatible material is a polymer film.

19. A thermal barrier as recited in claim 17, wherein the plurality of vapor barriers are comprised of a plurality of protrusions extending outwardly from an outer surface of the plug.

20. A thermal barrier as recited in claim 19, wherein the plurality of protrusions is affixed to the plug by a plurality of laminations.

21. A thermal barrier as recited in claim 20, further comprising:

a handle attached to the plug that extends through the plug to a bottom point of the plug located beneath the plurality of laminations so that the plug can be removed from the vessel by an upward pulling force exerted on the bottom point.

22. A thermal barrier as recited in claim 21, wherein the handle is comprised of a webbing material.

23. A thermal barrier as recited in claim 21, wherein the handle extends through the plug and is affixed to a canister assembly.

24. A thermal barrier as recited in claim 23, wherein the handle is comprised of a webbing material.

25. A thermal barrier as recited in claim 19, wherein the vapor barrier retains the liquid cryogen in the vaporous state within the vessel despite its orientation.

26. A thermal barrier as recited in claim 25, wherein the vapor barrier inhibits the mean free path of dense, boiling vapors through the Dewar opening.

27. A thermal barrier as recited in claim 15, wherein the incremental increase in vapor pressure is less than 2 psig.

28. A method for extending the holding time of a Dewar vessel having an outer casing and an inner vessel with each having openings at their tops connected together by a neck portion forming an evacuable space between the outer casing and the inner vessel and a Dewar opening into the inner vessel, comprising the step of:

inserting an insulative vapor plug and a vapor barrier into the neck portion, wherein the insulative vapor plug is sized so as to define an open space between it and the neck portion that allows a liquid cryogen in a vaporous state to vent from the inner vessel through the Dewar opening, and wherein the vapor barrier provides an interference between the plug and the neck portion to disrupt migration of the liquid cryogen in the vaporous state out of the Dewar opening through the open space but the vapor barrier does not form an airtight seal between the plug and the neck portion.

* * * * *